United States Patent [19]

Rathmayr et al.

[11] Patent Number: 4,957,090

[45] Date of Patent: Sep. 18, 1990

[54] PUMP NOZZLE FOR DIESEL ENGINES

[75] Inventors: Heinz Rathmayr, Hallein; Maximilian Kronberger, Steyr; Eugen Drummer, Steyr, all of Austria

[73] Assignee: Voest-Alpine Automotive Gesellschaft m.b.h., Linz, Austria

[21] Appl. No.: 332,173

[22] Filed: Apr. 3, 1989

[30] Foreign Application Priority Data

Apr. 8, 1988 [DE] Fed. Rep. of Germany ..... 3811796
Apr. 20, 1988 [DE] Fed. Rep. of Germany ..... 3813320

[51] Int. Cl.[5] ..... F02M 39/00

[52] U.S. Cl. ..... 123/501; 123/500; 123/496; 239/95

[58] Field of Search ..... 123/500, 501, 446, 447, 123/496, 503; 239/88–96

[56] References Cited

U.S. PATENT DOCUMENTS

| | | | |
|---|---|---|---|
| Re. 30,189 | 1/1980 | Perr | 123/501 |
| 2,147,390 | 2/1939 | Vaudet | 123/501 |
| 3,999,529 | 12/1976 | Davis . | |
| 4,146,178 | 3/1979 | Bailey | 123/500 |
| 4,630,586 | 12/1986 | Guntert | 123/500 |
| 4,705,005 | 11/1987 | Guntert | 123/500 |
| 4,708,114 | 11/1987 | Guntert | 123/500 |
| 4,836,170 | 6/1989 | Hafele | 123/501 |
| 4,840,161 | 6/1989 | Eckell | 123/500 |

FOREIGN PATENT DOCUMENTS

| | | | |
|---|---|---|---|
| 3143073 | 10/1981 | Fed. Rep. of Germany . | |
| 0164773 | 12/1980 | Japan | 123/500 |
| 2094901 | 9/1982 | United Kingdom | 123/500 |

*Primary Examiner*—Carl Stuart Miller
*Attorney, Agent, or Firm*—Cushman, Darby & Cushman

[57] ABSTRACT

A pump nozzle for a diesel engine, in which an injection pump element including a pump piston driven by a cam-shaft via a thrust element and a pump element bushing is combined with an injection nozzle to provide a unit to be associated to one motor cylinder. The pump piston is surrounded by a control sleeve which is non-rotatable relative to the pump element busing. The pump piston can be rotated for adjusting its orientation relative to the control sleeve for the purpose of adjusting the supplied amount of fuel. An adjuster for adjusting the amount is disposed at substantially the same level as of the thrust element. The control sleeve is arranged completely within a pump spring, which partly surrounds the pump element bushing. The pump dement bushing is formed integrally with a blind longitudinal bore which receives the pump piston. The pump spring extends from the level of the adjuster for adjusting the amount of fuel to be injected per injection, to the level of the working chamber of the pump piston. This provides an overlapping arrangement of the separate parts of the pump nozzle, so that the structural dimensions of the pump nozzle may be kept small.

7 Claims, 4 Drawing Sheets

PUMP NOZZLE FOR DIESEL ENGINES

BACKGROUND OF THE INVENTION

1. Field of the Invention

The invention relates to a pump nozzle for a Diesel engine, in which an injection pump element comprising a pump piston driven by a cam-shaft via a thrust element and a pump element bushing, is combined with an injection nozzle into a unit to be associated with one motor cylinder The pump piston is surrounded by a control sleeve that is non-rotatable relative to the pump element bushing. The pump piston can be rotated with a means for adjusting the amount relative to the control sleeve for the purpose of adjusting the supplied amount of fuel. The driving of the pump piston via the thrust element is usually effected by a cam, which is arranged, for example on a cam shaft of the engine. With a rocker lever driven by the cam, the thrust element is formed as a swivellable stilt or a sliding block. The rocker lever is active and is supported against a guiding sleeve acting on the pump piston and the pump spring. With direct drive by the cam, the thrust element is formed as a roller tappet or disc tappet, whereby the cam is active and which actuates the pump piston.

2. Description of the Prior Art

From DE-OS 31 43 073 there has become known an injection pump in which the pump spring is arranged in the upper part of the height of the pump piston. The means for adjusting the amount of fuel is arranged below the pump spring and beside the pump piston. This causes not only a relatively large overall height of the pump, but the overall width is also enlarged. The pump element bushing is made of two parts and is divided in the area of the high pressure chamber of the pump. Such a division makes necessary relatively large and heavily stressed sealing surfaces, which also enlarges the overall width. Also the lateral arrangement of the means for adjusting the amount of fuel enlarges the overall width.

SUMMARY OF THE INVENTION

It is an object of the invention to provide a pump nozzle with small structural dimensions and the invention provides the means for adjusting the amount is arranged in the vicinity of the thrust element, that the control sleeve is arranged completely within the pump spring, that the pump element bushing is integrally formed so as to have a blind hole for receiving the pump piston, and that the pump spring surrounds partly the pump element bushing extends from the vicinity of the means for adjusting the amount to the vicinity of the working chamber of the pump piston. Because the means for adjusting the amount is arranged in the vicinity of the thrust element, the overall height necessary for the thrust element is used for positioning the means for adjusting the amount. Because the pump element bushing is built in one piece and therefore no large-size seals are necessary in the area of the high pressure chamber, it is possible to provide the pump element bushing at this position with a diameter smaller than the diameter of the pump spring. The pump spring may therefore have a relatively small diameter and may, nevertheless, extend to the area of the working chamber or the high pressure chamber of the pump piston. Because the pump spring now extends from the vicinity of the means for adjusting the amount to the vicinity of the working chamber or the high pressure chamber of the pump piston, the axial length of the pump spring can be chosen so as to be relatively large, with a small axial extent for the pump nozzle. Because the control sleeve is positioned within the pump spring, a separate chamber for the control sleeve can be eliminated. As a whole, the overall height of the pump nozzle is reduced by the combination of these features. Because the pump spring surrounds the pump element bushing from the vicinity of the means for adjusting the amount or of the thrust element to about the height of the high pressure chamber, a large part of the overall height of the pump element bushing is used for the overall height of the pump spring.

According to the invention, the means for adjusting the amount suitably surrounds the thrust element so that the whole space around the thrust element may be used for positioning the means for adjusting the amount. According to the invention, suitably, the means for adjusting the amount comprises an element rotatable around the axis of the pump piston, which element is coupled with the pump piston. According to a preferred embodiment of the invention, the element rotatable around the axis of the pump piston is formed by the rotor of an electric servomotor.

According to the invention, a means which adjusts the control sleeve (17) in direction of the axis (13) of the pump piston (3) for adjusting the beginning of injection, is positioned in the vicinity of the end of the pump spring facing the thrust element outside the pump spring and under the means for adjusting the amount in the housing of the pump nozzle. Because the means for adjusting the beginning of injection of fuel is arranged between the means for adjusting the amount and the end of the pump spring facing the thrust element, the overall height of the pump nozzle is reduced. The overall width is, nevertheless enlarged on one side by the means for adjusting the beginning of injection, but the means for adjusting the beginning of injection is arranged in the area of the end of the pump spring facing the thrust element and in this area the pump nozzle does not extend into the cylinder head, so that, in this area, an enlargement of the width of the pump nozzle does not have negative consequences.

Normally, the upper end of the pump nozzle is guided by a guide sleeve in the housing of the pump nozzle. In this case according to the invention, the guide sleeve comprises suitable openings for the passage of connecting elements of the means for adjusting the amount and/or the beginning of injection.

According to the invention, the pump element bushing may comprise a bore for receiving a displacer piston, which bore is coaxial with the blind hole for receiving the pump piston. Therewith also, the cylinder of the displacer piston is integrated into the pump element bushing, which is made of one piece, and it is only necessary to connect the working chamber of the displacer piston with the high pressure chamber by a bore with small diameter. Therewith, the overall width is reduced relative to embodiments in which a cylinder for the displacer piston is positioned laterally at the pump piston bushing. This is of essential importance because the working chamber of the displacer piston must be in connection with the high pressure chamber or working chamber of the pump piston, and because this area of the pump nozzle extends into the cylinder head of the engine.

BRIEF DESCRIPTION OF THE DRAWING

In the drawing, the invention is schematically illustrated with reference to examples of embodiments.

DETAILED DESCRIPTION OF THE PREFERRED EMBODIMENTS

Figure 1:
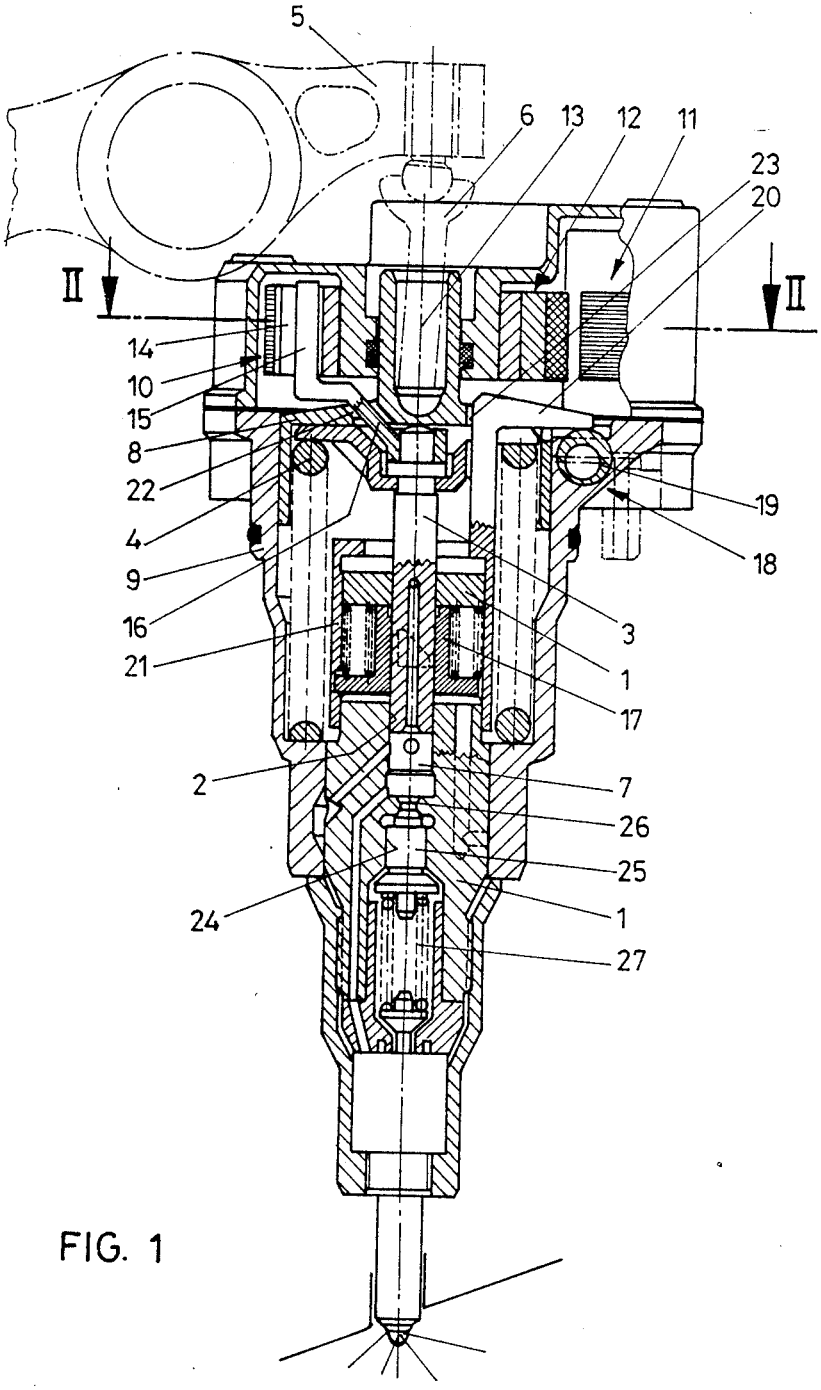
FIGS. 1 and 2 show an embodiment of a pump nozzle, with FIG. 1 being an axial section along line I—I of FIG. 2 and FIG. 2 being a section along line II—II of FIG. 1.
Figure 2:
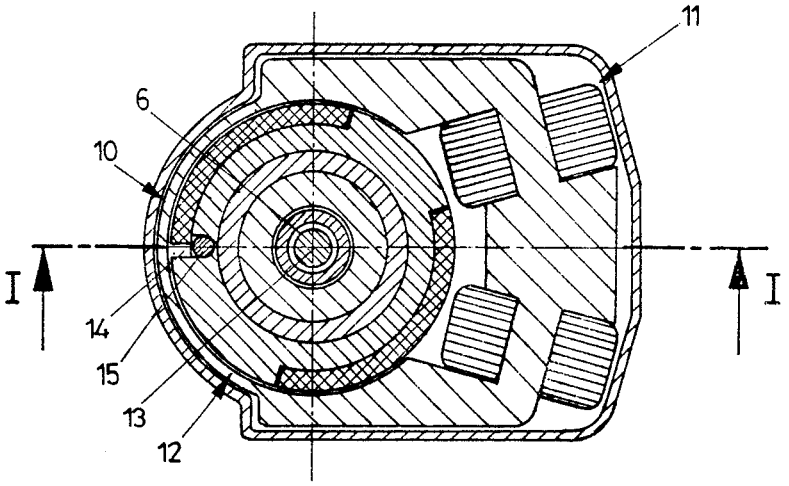

In the embodiment according to FIGS. 1 and 2, reference numeral 1 represents the pump element bushing, which comprises a blind hole 2, in which the pump piston 3 is guided. The pump piston 3 is driven against the force of the pump spring 4 by a cam shaft (not shown) by a rocker lever 5 and a thrust element formed as a stilt 6. Numerical 7 indicates the high pressure chamber, which forms the working chamber of the pump piston 3. As is shown in the drawing, the pump spring 4 extends downwards to the height of the high pressure chamber 7. Therefore, the pump spring may be dimensioned to be relatively long, with the overall height of the pump nozzle being small. The upper portion of the pump spring is guided by a guide sleeve 8 in the housing 9 of the pump nozzle. The stilt 6, driven by the rocker lever 5, is supported against the guide sleeve 8, which guide sleeve 8 actuates the pump piston 3.

Numeral 10 indicates the means for adjusting the amount or volume of fuel, which means is formed by an electric servomotor 11. The rotor 12 of the electric servo motor 11 is rotatable around an axis 13, which is positioned concentrically to a neutral position of the stilt 6. The rotor 12 comprises a slot 14, with which engages a crank arm 15, which is drivingly connected with the pump piston 3 by a connecting element 16. Numeral 17 designates a control sleeve, by means of which the pump piston 3 is rotated by the crank arm 15 relative to the control sleeve for adjusting the amount of fuel.

The means for adjusting the beginning of feeding or injection of fuel 18, which is the subject matter of a commonly assigned, copending U.S. patent application, comprises a hydraulic piston 19, which is shiftable in its axial direction and which acts with an inclined surface on a hook-like connecting element 20, which is connected with a sleeve 21. The sleeve 21 is coupled with the control sleeve 17 in axial direction and is non-rotatable relative thereto.

The control sleeve 17 changes with its upper edge the beginning of feeding. In this embodiment, the means 18 for adjusting the beginning of feeding is thus arranged in the upper area of the pump spring 4 outside thereof.

The guide sleeve comprises openings 22 and 23 for the passage of the connecting element 16 of the means 10 for adjusting the amount and for the passage of the hook-like connecting element 20 of the means 18 for adjusting the beginning of feeding.

Coaxially with the blind hole 2, for guiding the pump piston 3, there is provided a second blind hole 24 in the pump element bushing 1, which second blind hole starts from the other end of the pump element bushing. In this blind hole, a displacer piston 25 is guided, which is subjected against the force of a spring 27 to the pressure in the high pressure chamber 7 through a connecting bore 26. In this way, also, the displacer piston is integrated into the pump element bushing.

Figure 3:
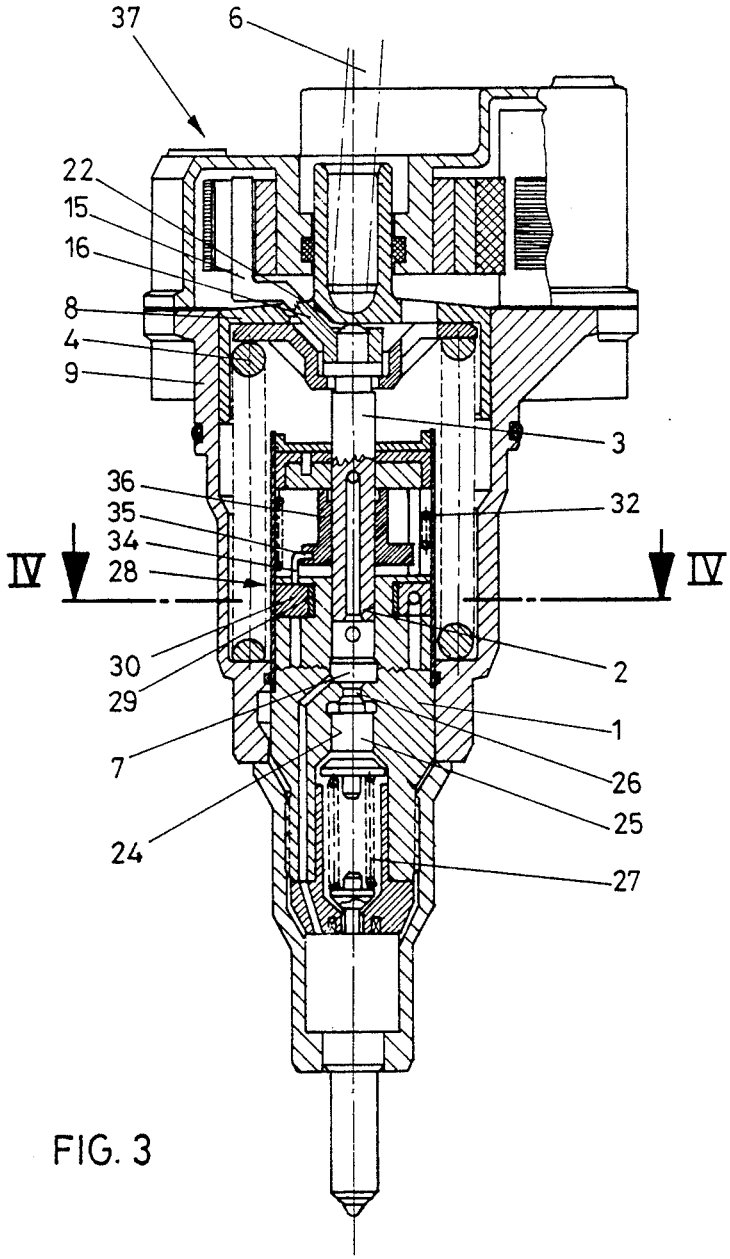
FIGS. 3 and 4 show another embodiment with, FIG. 3 being an axial section along line III—III of FIG. 4 and FIG. 4 being an axial section along line IV—IV of FIG. 3.
Figure 4:
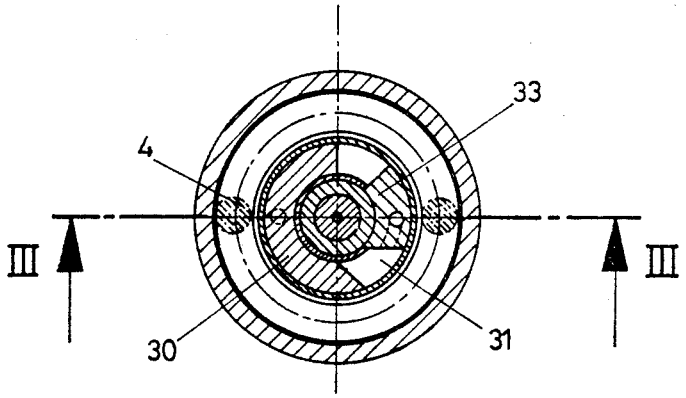

The embodiment according to FIGS. 3 and 4 differs from the embodiment according to FIGS. 1 and 2 essentially in that the means 28 for adjusting the beginning of feeding is arranged completely within the pump spring 4. This means 28 for adjusting the beginning of feeding, Which is the subject matter of a commonly assigned, copending U.S. patent application, comprises a piston 30 having the shape of an annular segment, which piston is sealingly guided in an annular groove 29 of the pump element bushing 1 and is rotated by the pressure of a hydraulic medium in a working chamber 31 against the force of a torsion spring 32. Numeral 33 designates a part rigidly connected with the pump element bushing 1, which part limits the working chamber 31. A hook-like guiding element 35 is connected with the piston 30 having the shape of an annular segment and is engaged with an annular groove 35 of a control sleeve 36. The annular groove 35 is inclined to a plane perpendicular to the axis of the pump piston 3, and by rotating the piston 30 having the shape of an annular segment, the control sleeve 36 is lifted and lowered so that the position of the upper edge of the control sleeve 36 defines the beginning of feeding or injection.

The pump spring 4 extends from the upper part downwards to the vicinity of the high pressure chamber 7 also in this embodiment. The means 37 for adjusting the amount is again positioned in the vicinity of the stilt 6 and is formed in the same manner as in FIG. 1. The rotation of the piston 3 is effected by the crank 15 and the connecting element 16, which is drivingly connected with the pump piston 3. The guide sleeve 8, which guides the upper end of the pump sping 4 relative to the housing 9 of the pump nozzle, again comprises an opening 22 for the passage of the connecting element 16. An opening for the passage of a connecting element of the means 28 for adjusting the beginning of feeding is not necessary, because the whole means 28 for adjusting the beginning of feeding is positioned within the pump spring 4.

What is claimed is:

1. In a pump nozzle for a diesel engine, in which an injection pump element including a pump piston which is driven by a cam shaft via a thrust element and a pump element bushing, is combined with an intermittently opened injection nozzle for one motor cylinder, wherein the pump piston is circumferentially surrounded by a control sleeve which is non-rotatable relative to the pump element bushing, and wherein an adjusting means is provided for rotating the pump piston relative to the control sleeve for adjusting the amount of fuel injected for each cycle of opening of the injection nozzle, the improvement comprising:

said adjusting means is disposed at substantially the same level as the thrust element relative to the longitudinal axis of the pump nozzle;

said control sleeve is disposed completely within a pump spring;

said pump element bushing is formed as an integral member with a blink longitudinal bore which directly receives said pump piston;

said pump spring circumferentially surrounds said pump element bushing throughout a portion of the longitudinal extent of said pump element bushing; and said pump spring extends from the level of said adjusting means to the level of a working chamber of said pump piston.

2. The pump nozzle of claim 1, wherein:

said adjusting means circumferentially surrounds said thrust element.

3. The pump nozzle of claim 1, wherein:

said adjusting means includes an element which is rotatable around the longitudinal axis of the pump piston and is coupled to the pump piston for rotating the pump piston.

4. The pump nozzle of claim 3, wherein said rotatable element of said adjusting means is constituted by a rotor of an electric servomotor.

5. The pump nozzle of claim 1, wherein:

said pump element bushing further includes a second longitudinal blind bore formed in an opposite end thereof from said blind bore, said second longitudinal blind bore being coaxial with the first-defined blind bore and receiving a displacer piston.

6. The pump nozzle of claim 1, wherein:

a means is provided for adjusting axial positioning of the control sleeve along the longitudinal axis of the pump piston for adjusting when injection begins in of each cycle of opening of the injection nozzle, said axial positioning adjusting means being disposed:

at substantially the same level as a respective end of said pump spring which faces said thrust element, outside said pump spring, under said adjusting means for rotating said pump piston, and within a housing of said pump nozzle.

7. The pump nozzle of claim 6, wherein:

said pump spring has an upper end guided by a guide sleeve which includes openings for passage of connectors for at least one of said means for adjusting axial positioning of the control sleeve and said adjusting means for rotating said pump piston.

* * * * *